US005558354A

United States Patent [19]

Lion

[11] Patent Number: 5,558,354

[45] Date of Patent: Sep. 24, 1996

[54] COMBINATION SKIS AND MOUNTING PLATE ASSEMBLY

[76] Inventor: Ronald K. Lion, 375 Summit Rd., Watsonville, Calif. 95076

[21] Appl. No.: 392,133

[22] Filed: Feb. 23, 1995

[51] Int. Cl.[6] ..... A63C 5/00

[52] U.S. Cl. ..... 280/607; 280/618; 280/818

[58] Field of Search ..... 280/607, 617, 280/618, 817, 818, 14.2

[56] References Cited

U.S. PATENT DOCUMENTS

| | | | |
|---|---|---|---|
| 3,921,994 | 11/1975 | Locati | 280/607 |
| 4,449,735 | 5/1984 | McDougall | 280/818 |
| 4,647,062 | 3/1987 | McDougall | 280/607 |
| 4,674,765 | 6/1987 | Powell | 280/607 |
| 4,678,200 | 7/1987 | Powell | 280/607 |
| 5,458,370 | 10/1995 | Melcher | 280/817 |

*Primary Examiner*—Richard M. Camby

*Attorney, Agent, or Firm*—Jeffrey A. Hall

[57] ABSTRACT

A combination ski and binding plate apparatus comprising a first and second mounting plate assembly for supporting mounting plates for boot bindings and for operably linking a pair of skis. The first and second mounting plate assemblies each comprise a four bar linkage assembly including a first inner bar and a first outer bar operably secured to a mounting plate. The first inner bar is pivotally secured to the first outer bar. A rear linkage assembly including a rear inner bar and a rear outer bar are operably secured to the mounting plate. The rear inner bar is pivotally secured to the rear outer bar. Both the front linkage assembly and rear linkage assembly are secured to both skis allowing the skis to pivot and move about a central pivot point allowing a downward pressure or force on either side of the mounting plate to be translated into an upward force on an opposite side of the plate providing an upward lifting force to a ski edge beneath the opposite side of the plate from which the downward or force is exerted on the plate resulting in a parallel synchronized motion with outside and inside edges of the skies always maintaining the same position relative to each other.

17 Claims, 2 Drawing Sheets

COMBINATION SKIS AND MOUNTING PLATE ASSEMBLY

BACKGROUND OF THE INVENTION

1. Field of Invention

This invention relates to skis, snowboards, and snow sleds, and particularly to mounting plate apparatuses for skis and snowboard boot bindings adapted to be mounted on skis, snowboards, sleds, or monoskis, for edge control, balance, and greater stability. The mounting plate apparatus for skis and modified snowboards disclosed herein allows for a new ski and snowboard product where skis or a modified snowboard is connected together by the mounting plate apparatus disclosed herein providing a new means of movement over snow or ice.

2. Description of the Related Art

Various skis, snowboards, and associated boot binding apparatuses have been proposed and implemented. The development of skis, monoskis, and snowboards has been focused on either two independent skis, a single monoski, or snowboard to hold and support a user while mounted to the ski or snowboard. Numerous provisions for supporting boot bindings and support plate apparatuses have also been proposed and implemented along these lines.

Although a large variety of skis, snowboards and associated apparatuses have been developed, there exists significant problems and limitations with prior skis and snowboards. Prior snowboards utilize a single board or ski that is quite wide. Steering and control is accomplished by leaning onto an edge and thereby accomplishing a turn. The dexterity and mobility that skiers enjoy is severely encumbered by this single wide ski. On the other hand, the great popularity of snowboarding stems from the freedom and "feel" of the snowboard ride. The ideal element for snowboarding is a deep powder snow where quick turns and agility are not needed. Under conditions of hard packed snow, moguls, or ice, control and enjoyment of the sport quickly diminish. The lack of edge control and dextrous movement that skiers enjoy is lacking under such circumstances.

The present invention discloses a completely new and novel means of enjoying snow sports by combining the most desirable elements of snowboarding and skiing. The present invention provides a combination ski and mounting plate assembly for boot bindings where both skis are linked together in approximately the same area that a snowboard or monoski would occupy. However, in the present invention the skis are separate yet operably linked by a pivotal linking apparatus for supporting a mounting plate for boot bindings which allows the skis to pivot and edge as a single pair.

Accordingly, it is the primary object of this invention to provide a combination skis and mounting plate assembly where two skis are operably linked by a boot binding mounting plate assembly so the two skis are held and positioned in a defined area while the pivotal mounting permits the skis to pivot and edge as a single pair allowing for increased maneuverability, increased turnability, more edge control, superior "feel", and greater stability than all prior skis or snowboards.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purpose of the invention as embodied and broadly described herein, a combination ski and mounting plate assembly is provided, comprising: a pair of skis or modified snowboard; a first mounting plate assembly for supporting a mounting plate for a boot binding on the skis or modified snowboard; the first mounting plate assembly is pivotally secured to both of the pair of skis or snowboard so that the pair of skis are operably linked together by the first mounting plate assembly. The mounting plate assembly preferably includes a four bar linkage assembly comprising a front linkage assembly including a first inner bar and a first outer bar which are operably secured to the mounting plate by pivot means and the first inner bar is pivotally secured to the first outer bar. A rear linkage assembly including a rear inner bar and a rear outer bar operably are operably secured to the mounting plate. The rear inner bar is preferably pivotally secured to the rear outer bar. Both the front linkage assembly and rear linkage assembly are operably secured to both skis allowing the skis to pivot and move about a central pivot point allowing a downward pressure on either side of the mounting plate to be translated into an upward force on an opposite side of the plate, thereby providing an upward lifting force to a ski edge on an opposite side of the plate, resulting in a parallel synchronized motion of both skis with outside and inside edges of the skis always maintaining the same position relative to each other. Preferably, two mounting plate assemblies are used for each pair of skis and are spaced and positioned as desired by the user, depending upon the size of the user, the use, and the balance or "feel" desired. Or, alternatively, both assemblies may be combined in a single unit, for example, for use with a monoski.

The skis or modified snowboard may be provided in a wide variety of shapes and sizes. Of course, many different colors, textures, and combinations thereof may be provided as desired. The mounting plate assembly is preferably composed of any durable, resilient material, however, metal, alloy, plastic, or composites are preferred.

In accordance with the present invention there also is provided a moveable, pivotable mounting plate linking apparatus for mounting on a pair of skis, comprising: a first mounting plate assembly for supporting a mounting plate for a boot binding; said first mounting plate assembly being operably mounted to both of said pair of skis so that said pair of skis are operably linked together by said first mounting plate assembly; said mounting plate assembly includes a four bar linkage assembly comprising a front linkage assembly including a first inner bar and a first outer bar operably secured to said mounting plate, said first inner bar being pivotally secured to said first outer bar; a rear linkage assembly including a rear inner bar and a rear outer bar operably secured to said mounting plate, said rear inner bar being pivotally secured to said rear outer bar; said front linkage assembly and said rear linkage assembly operably connecting both skis together allowing the skis to pivot and move about a central pivot point allowing a downward pressure on either side of the mounting plate to be translated into an upward force on an opposite side of said plate, thereby providing an upward lifting force to a ski edge beneath the opposite side of the plate; and, a second mounting plate assembly for supporting a mounting plate for a boot binding; said second mounting plate assembly being operably mounted to both of said pair of skis and spaced from said first mounting plate assembly so that said pair of skis are operably linked together by said second mounting plate assembly; said second mounting plate assembly includes a four bar linkage assembly comprising a front linkage assembly including a first inner bar and a first outer bar operably secured to said mounting plate, said first inner bar being pivotally secured to said first outer bar; a rear linkage assembly including a real inner bar and a rear outer bar operably are secured to said mounting plate; said real inner bar being pivotally secured to said rear outer bar; said front linkage assembly and said rear linkage assembly operably connect both skis together allowing the skis to pivot and move about a central pivot point allowing a downward pressure on either side of said mounting plate to be translated into an upward force on an opposite side of the plate resulting in a parallel synchronized motion with outside and inside edges of the skis always maintaining the same position relative to each other.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIMENTS

Reference will now be made in detail to the present preferred embodiments of the invention as illustrated in the accompanying drawings.

In accordance with the present invention, there is provided a combination ski and mounting plate assembly, comprising: a pair of skis; a first mounting plate assembly for supporting a mounting plate for a boot binding; said first mounting plate assembly being pivotally secured to both of said pair of skis so that said pair of skis are operably linked together by said first mounting plate assembly; said mounting plate assembly includes a four bar linkage assembly comprising a front linkage assembly including a first inner bar and a first outer bar operably secured to said mounting plate; said first inner bar being pivotally secured to said first outer bar; a rear linkage assembly including a rear outer bar and a rear inner bar are operably secured to said mounting plate, said rear inner bar being pivotally secured to said rear outer bar; said front linkage assembly and said rear linkage assembly being operably secured to both of said skis allowing the skis to pivot and move about a central pivot point allowing a downward pressure on either side of said mounting plate to be translated into an upward force on an opposite side of said plate, thereby providing an upward lifting force on a ski edge beneath said opposite side of said plate; and a second mounting plate assembly for supporting a mounting plate for a boot binding; said second mounting plate assembly being operably mounted to both skis of said pair of skis and spaced form said first mounting plate assembly so that said pair of skis are operably linked together by said second mounting plate assembly; said second mounting plate assembly includes a four bar linkage assembly comprising a front linkage assembly including a first inner bar and a first outer bar operably secured to said mounting plate, said first inner bar being pivotally secured to said first outer bar; a rear linkage assembly including a rear inner bar and a mar outer bar are operably secured to said mounting plate; said rear inner bar being pivotally secured to said rear outer bar; said front linkage assembly and said rear linkage assembly operably connecting both skis together allowing for the skis to pivot and move about a central pivot point, allowing a downward pressure on either side of said mounting plate to be translated into an upward force on an opposite side of said plate, thereby providing an upward lifting force to a ski edge beneath said opposite side of said plate resulting in a parallel synchronized motion with outside and inside edges of the skis always maintaining the same position relative to each other.

Figure 1:
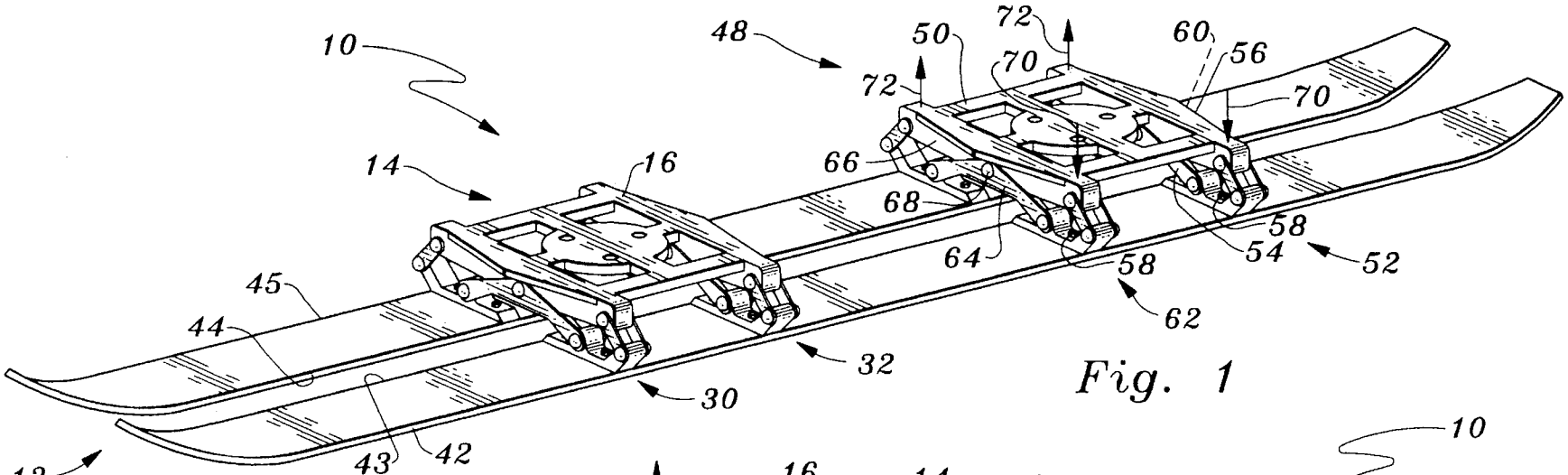
FIG. 1 is a front perspective view of a combination skis and mounting plate assembly, according to the invention.

In FIG. 1, the combination skis and mounting plate assembly 10 is shown with pair of skis 12 with edges 42, 43, 44, and 45, and a first mounting plate assembly 14 for supporting a boot binding, such as a ski boot binding, a snowboard boot binding, or the like. First mounting plate assembly 14 is secured to skis 12 by rivets 18, or alternatively by bolts, pins, screws, welds, or other mechanical fastening means. First mounting plate assembly 14 thus operably connects and links the pair of skis 12. Of course, skis 12 may be any type or style of skis, or combination of skis, however, in the preferred embodiment of the invention skis 12 are preferably configured as a modified ski, resembling, in general terms, a monoski or snowboard which has be divided in half with mounting plate assembly 14 securing the two skis or parts together. Mounting plate assembly 14 is preferably a four bar linkage assembly 20 comprising a front linkage assembly 22 including a first inner bar 24 and a first outer bar 26 secured by rivets or bolts 18. First inner bar 24 is pivotally secured to first outer bar 26 by bolt 28, or alternatively by a pin, rivet or the like.

Figure 2:
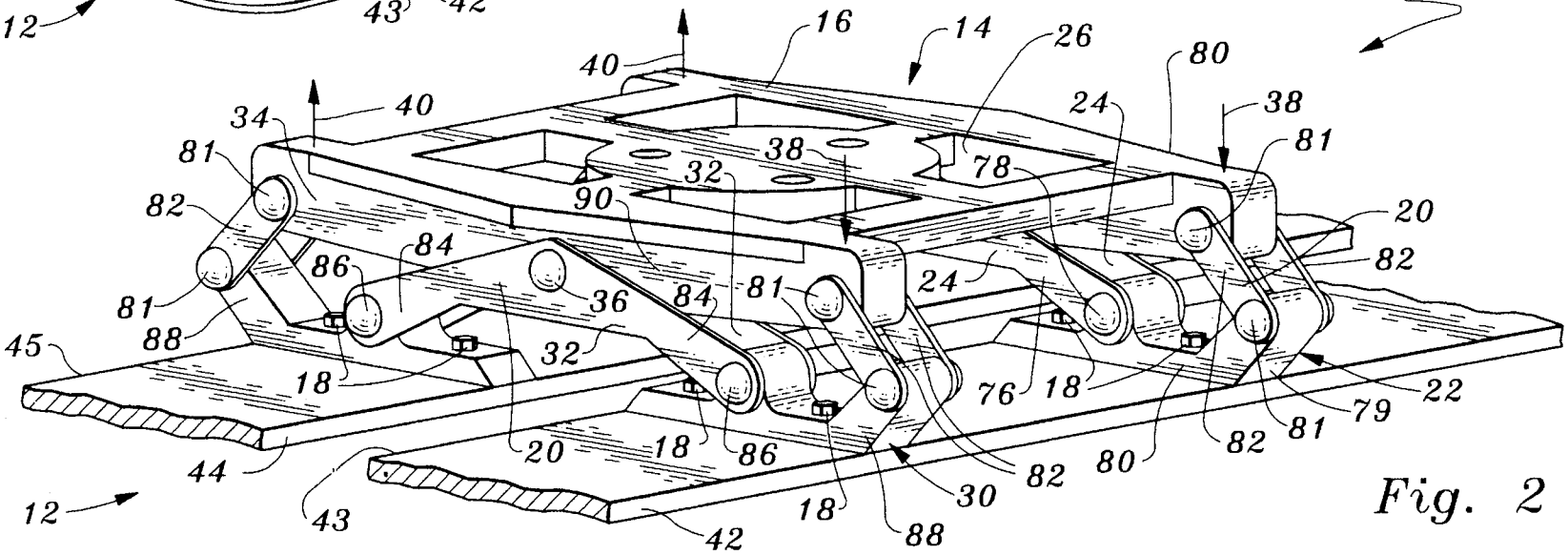
FIG. 2 is a perspective view of a mounting plate assembly, according to the invention.
Figure 3:
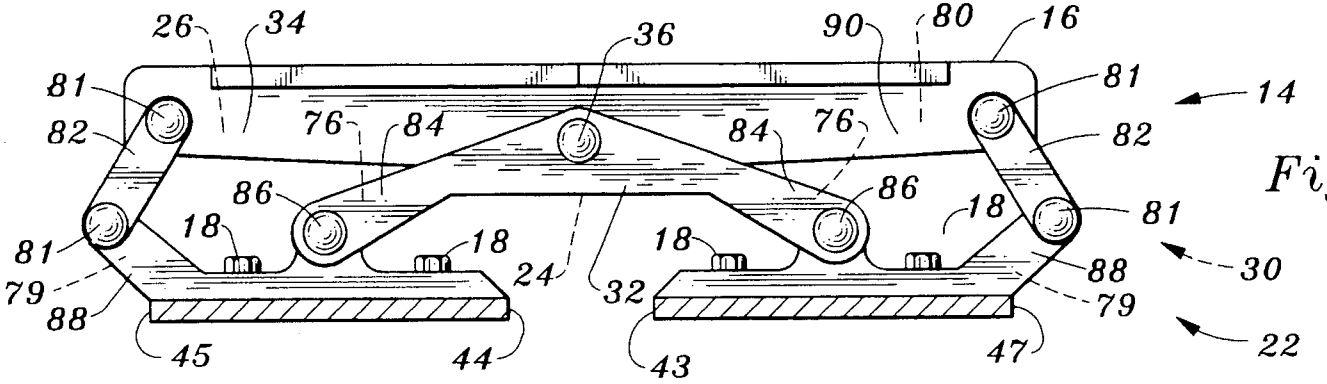
FIG. 3 is a end view of a mounting plate assembly, according to the invention.
Figure 4:
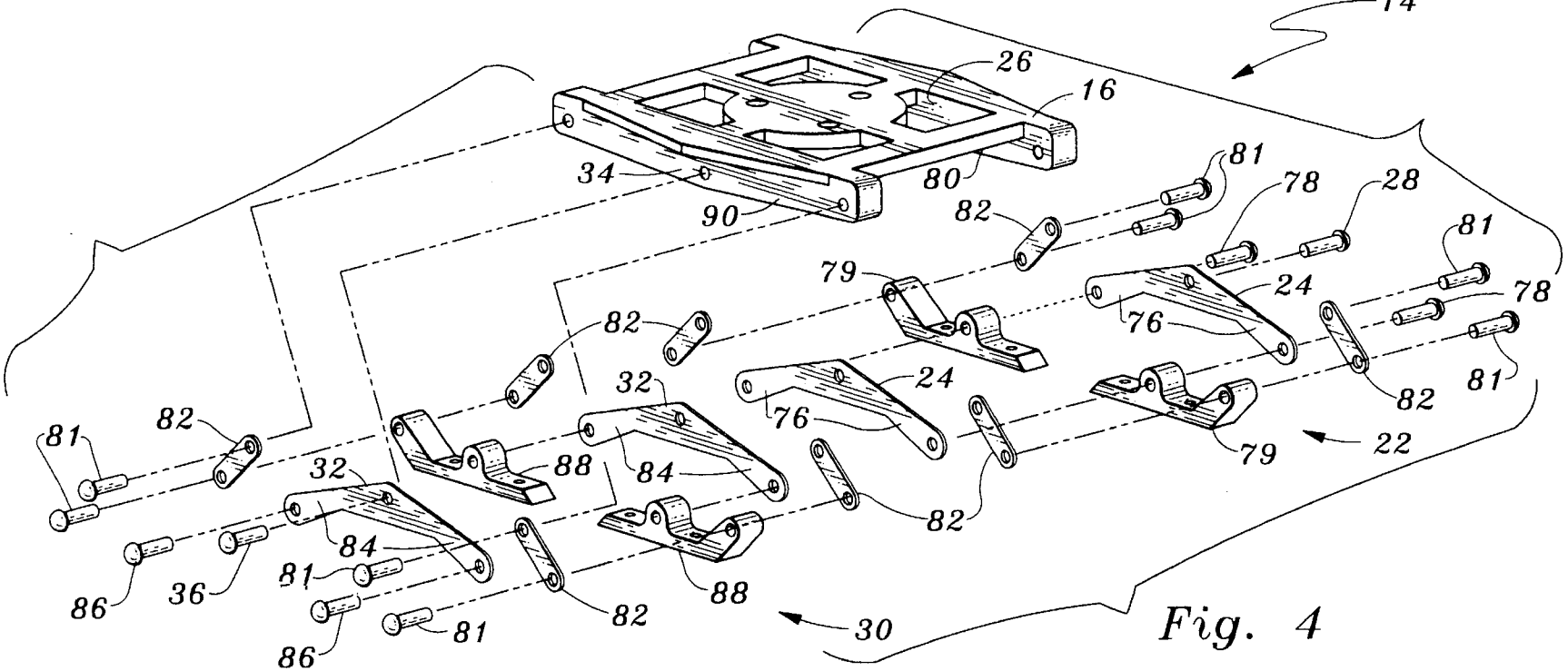
FIG. 4 is an exploded view of a mounting plate assembly, according to the invention.

First inner bar 24 of front linkage assembly 22 of first mounting plate assembly 14 preferably comprises a pivot element 74 including two spaced legs 76 which are pivotally secured to first outer bar 26 by pins or bolts 78 and pivot pin 28. First outer bar 26 preferably comprises two elongated elements 79 and 80 which are pivotally secured together by connecting elements 82 with pivoting bolts or pins 81. As can be seen in FIGS. 1, 2, and 3, elongated elements 79 and 80 and connecting elements 82 are preferably configured and positions so as to allow elongated element 80 and connecting elements 82 to pivotally extend beyond the edge of the skis. This allows for the downward forces exerted on the mounting plate to be translated into a pivot or rotation about the outside edge of the ski, providing greater control, balance, and stability of the skis by this extension of elements 80 and 82 beyond the ski edge. Connecting elements 82, best seen in FIGS. 1 and 2, preferably comprise a pair of shafts rotatably secured to elongated elements 80 on both ends of elongated elements 80 as shown.

A rear linkage assembly 30 is shown in FIGS. 1–3, including a rear inner bar 32 and a rear outer bar 34 secured to mounting plate 14 with rivets or bolts 18. The rear inner bar 32 is preferably secured to rear outer bar 36 by pins or bolts 86. Rear inner bar 32 preferably comprises a pivot bar 36 including two spaced legs 84. Legs 84 are preferably rotatably secured to rear outer bar 34 by pins or bolts 86. Rear outer bar 34 preferably comprises two elongated elements 88 and 90 pivotally secured together at both ends by connecting elements 82 which may be a pair of shafts.

The front linkage assembly 22 and rear linkage assembly 30 pivotally securing skis 12 together allow the user to pivot and move the skis around a central pivot point positioned approximately at pins or bolts 36 and 28 on the first mounting plate assembly, allowing a downward pressure or force shown for example, as arrows 38, to be exerted on either side of mounting plate 16 to be translated by assemblies 22 and 30 into an upward force 40 on an opposite side of plate 16, thereby providing an upward lifting force on a ski edge beneath the opposite side of the mounting plate to which the downward force 38 was applied.

As seen in FIG. 1, a second mounting plate assembly 48 for supporting a mounting plate 50 for a ski boot or snowboard boot binding is shown. Second mounting plate assembly 48 is preferably the same as first mounting plate assembly 14, however, it is used for the users other foot boot binding. Second plate assembly 48 is described here for further clarity, however, it is essentially the same assembly as first mounting plate assembly 14 and preferably positioned and secured on skis 12 at a distance from first mounting plate assembly 14. Second mounting plate assembly 48 is secured on skis 12 so that the pair of skis are operably linked together, as described for first mounting plate assembly 14. Second mounting plate assembly preferably includes a four bar linkage assembly comprising a front linkage assembly 52 including first inner bar 54 and first outer bar 56 operably secured to mounting plate 50 by rivets or bolts 58. First inner bar 54 is pivotally secured with bolt or pin 60 to outer bar 56. First inner bar 54 preferably comprises a pivot element 74 including two spaced legs 76. Legs 76 are preferably pivotally secured to first outer bar 56 by bolts or pins 78. First outer bar 56 preferably comprises two elongated elements 80 pivotally connected by connecting elements 82 at both ends of the elongated element. Connecting elements 82, in the preferred embodiment, are a pair of shafts at both ends of elongated elements, similar to that described for first mounting plate assembly 14. A rear linkage assembly 62 including rear inner bar 64 and rear outer bar 66 are operably secured to skis 12 by rivets, bolts, or pins 58. Rear inner bar 64 is pivotally secured to rear outer bar 66 by bolts or pins 68.

Rear inner bar 64 of rear linkage assembly 62 of second mounting plate assembly 48 preferably comprises a pivot element 24 including two spaced legs 76. Legs 76 being pivotally secured to rear outer bar 66 of rear linkage assembly 62. The rear outer bar 66 or rear linkage assembly preferably comprises two elongated elements 88 and 90 connected by a pair of pivotally secured connecting elements 82, which preferably comprise a pair of shafts rotatably secured by bolts or pins 81 at both ends of the elongated elements as shown in FIGS. 1–4. As described for first mounting plate assembly 14, the second mounting plate assembly 48 rotatably binds skis 12 together allowing them to pivot and move about a central pivot point allowing a downward pressure, shown for example as arrow 70, on either side of mounting plate 50 to be translated into an upward force on an opposite side of plate 50, thereby providing a upward lifting force, shown for example as arrow 72, to a ski edge beneath the opposite side of the binding plate to which the downward pressure was applied. This results in a parallel synchronized motion of the skis with outside and inside edges 42, 43, 44, and 45 always maintaining the same position relative to each other, and providing a truly unique and superior level of control, "feel", balance,turning ability, and stability.

Mounting plate assembly 14 and 48 are preferably composed of a durable resilient material, such as metal, however, other durable, resilient materials may also be used such as composites. Mounting plates 16 and 50 may be configured for any type of ski or snowboard boot binding and thus may have various arrangements of apertures, grooves, or placement of support elements without departing from the spirit or scope of the invention.

Similarly, first mounting plate assembly 14 and second mounting plate assembly 48 may be positioned on skis as desired, that is, the distance between the mounting of assemblies 14 or 48 may be varied depending upon the size, weight, mad personal preferences of the user.

In operation and use the combination ski and mounting plate apparatus 10 may be used under any conditions and environment that skis, monoskis, sleds, or snowboards are used. Mounting plate assemblies 14 and 48 may be provided riveted or bolted to the skis or provided with a releasable attachment means so that they could be removed and adjusted as desired. For example, rivets or bolts 18 could be substituted with bolts with a "quick release" type mechanism, or clamp, allowing for release and removal of the mounting plate assemblies 14 and 48. In alternative embodiments, mounting assemblies 14 and 48 may be combined into a single unit, for example, in the case of a monoski, however, it is preferable to have two separate linkage assemblies as described.

As is evident from the above description, a wide variety of designs or styles of the combination ski and mounting plate assembly described herein may be provided. Various plate configurations and binding styles am readily accommodated with the present invention. Accordingly, additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A combination ski and mounting plate assembly, comprising:

a pair of skis;

a first mounting plate assembly for supporting a mounting plate for a boot binding; said first mounting plate assembly being pivotally secured to both of said pair of skis so that said pair of skis are operably linked together by said first mounting plate assembly; said mounting plate assembly includes a four bar linkage assembly comprising a front linkage assembly including a first inner bar and a first outer bar operably secured to said mounting plate; said first inner bar being pivotally secured to said first outer bar; a rear linkage assembly including a rear inner bar and a rear outer bar are operably secured to said mounting plate, said rear inner bar being pivotally secured to said rear outer bar; said front linkage assembly and said rear linkage assembly being operably secured to both skis allowing the skis to pivot and move about a central pivot point allowing a downward pressure on either side of said mounting plate to be translated into an upward force on an opposite side of said plate, thereby providing an upward lifting force on a ski edge beneath said opposite side of said plate; and a second mounting plate assembly for supporting a mounting plate for a boot binding; said second mounting plate assembly being operably mounted to both skis of said pair of skis and spaced from said first mounting plate assembly so that said pair of skis are operably linked together by said second mounting plate assembly; said second mounting plate assembly includes a four bar linkage assembly comprising a front linkage assembly including a first inner bar and a first outer bar operably secured to said mounting plate, said first inner bar being pivotally secured to said first outer bar; a rear linkage assembly including a rear inner bar and a mar outer bar are operably secured to said mounting plate; said rear inner bar being pivotally secured to said rear outer bar; said front linkage assembly and said rear linkage assembly operably connecting both skis together allowing for the skis to pivot and move about a central pivot point allowing a downward pressure on either side of said mounting plate to be translated into an upward force on an opposite side of said plate, thereby providing an upward lifting force to a ski edge beneath said opposite side of said plate resulting in a parallel synchronized motion with outside and inside edges of the skis always maintaining the same position relative to each other.

2. The combination ski and mounting plate assembly of claim 1, wherein said first inner bar of said front linkage assembly of said first mounting plate assembly comprises a pivot element including two spaced legs, said spaced legs being pivotally secured to said first outer bar of said first linkage assembly.

3. The combination ski and mounting plate assembly of claim 1, wherein said first outer bar of said front linkage assembly of said first mounting plate assembly comprises two elongated elements pivotally connected by a pair of pivotally secured connecting elements.

4. The combination ski and mounting plate assembly of claim 3, wherein said pair of pivotally secured connecting elements each comprises a pair of shafts rotatably secured to said pair of elongated elements of said first outer bar of said front linkage assembly of said first mounting plate assembly.

5. The combination ski and mounting plate assembly of claim 1, wherein said rear inner bar of said rear linkage assembly of said first mounting plate assembly comprises a pivot element including two spaced legs, said legs being pivotally secured to said rear outer bar of said rear linkage assembly.

6. The combination ski and mounting plate assembly of claim 1, wherein said rear outer bar of said first mounting plate assembly comprises two elongated elements pivotally connected by a pair of pivotally secured connecting elements.

7. The combination ski and mounting plate assembly of claim 6, wherein said pair of pivotally secured connecting elements each comprises a pair of shafts rotatably secured to said two elongated elements of said rear outer bar of said rear linkage assembly of said first mounting plate assembly.

8. The combination ski and mounting plate assembly of claim 1, wherein said first inner bar of said front linkage assembly of said second mounting plate assembly comprises a pivot element including two spaced legs, said spaced legs being pivotally secured to said first outer bar of said first linkage assembly.

9. The combination ski and mounting plate assembly of claim 1, wherein said first outer bar of said front linkage assembly of said second mounting plate assembly comprises two elongated elements pivotally connected by a pair of pivotally secured connecting elements.

10. The combination ski and mounting plate assembly of claim 9, wherein said pair of pivotally secured connecting elements of said front linkage assembly of said second mounting plate assembly each comprise a pair of shafts rotatably secured to said pair of elongated elements of said first outer bar.

11. The combination ski and mounting plate assembly of claim 1, wherein said rear inner bar of said rear linkage assembly of said second mounting plate assembly comprises a pivot element including two spaced legs, said spaced legs being pivotally secured to said rear outer bar of said rear linkage assembly.

12. The combination ski and mounting plate assembly of claim 1, wherein said rear outer bar of said rear linkage assembly of said second mounting plate assembly comprises two elongated elements pivotally connected by a pair of pivotally secured connecting elements.

13. The combination ski and mounting plate assembly of claim 1, wherein said pivotally secured connecting elements connecting said two elongated elements of said rear linkage assembly of said second mounting plate assembly each comprise a pair of shafts rotatably secured to the two elongated elements.

14. A moveable, pivotable mounting plate linking apparatus for mounting on a pair of skis, comprising:

a first mounting plate assembly for supporting a mounting plate for a boot binding; said first mounting plate assembly being operably mounted to both of said pair of skis so that said pair of skis are operably linked together by said first mounting plate assembly; said mounting plate assembly includes a four bar linkage assembly comprising a front linkage assembly including a first inner bar and a first outer bar operably secured to said mounting plate, said first inner bar being pivotally secured to said first outer bar, and a rear linkage assembly including a rear, inner bar and a rear outer bar operably secured to said mounting plate, said rear inner bar being pivotally secured to said rear outer bar; said front linkage assembly and said rear linkage assembly operably connecting both skis together allowing the skis to pivot and move about a central pivot point allowing a downward pressure on either side of said mounting plate to be translated into an upward force on an opposite side of said plate, thereby providing a upward lifting force to a ski edge beneath said opposite side of said plate; and a second mounting plate assembly for supporting a mounting plate for a boot binding; said second mounting plate assembly being operably mounted to both of said pair of skis and spaced from said first mounting plate assembly so that said pair of skis are operably linked together by said second mounting plate assembly; said second mounting plate assembly includes a four bar linkage assembly comprising a front linkage assembly including a first inner bar and a first outer bar operably secured to said mounting plate, said first inner bar being pivotally secured to said first outer bar, and a rear linkage assembly including a rear inner bar and a rear outer bar operably secured to said mounting plate; said rear inner bar being pivotally secured to said rear outer bar; said front linkage assembly and said rear linkage assembly operably connecting both skis together allowing the skis to pivot and move about a central pivot point allowing a downward pressure on either side of said mounting plate to be translated into an upward force on an opposite side of said plate, thereby providing an upward lifting force to a ski edge beneath said opposite side of said plate resulting in a parallel synchronized motion with outside and inside edges of the skis always maintaining the same position relative to each other.

15. The mounting plate linking apparatus of claim 14, wherein said first mounting plate assembly and said second mounting plate assembly are mounted on said pair of skis by rivets.

16. The mounting plate linking apparatus of claim 14, wherein said first mounting plate assembly and said second mounting plate assembly are mounted on said pair of skis by bolts.

17. The mounting plate linking apparatus of claim 14, wherein said first mounting plate assembly and said second mounting plate assembly are composed of metal.

* * * * *